US009295604B2

(12) United States Patent
Zoss et al.

(10) Patent No.: US 9,295,604 B2
(45) Date of Patent: Mar. 29, 2016

(54) HUMAN MACHINE INTERFACE FOR HUMAN EXOSKELETON

(75) Inventors: Adam Zoss, Berkeley, CA (US); Katherine Strausser, Berkeley, CA (US); Tim Swift, Albany, CA (US); Russ Angold, American Canyon, CA (US); Jon Burns, Oakland, CA (US); Homayoon Kazerooni, Berkeley, CA (US); Dylan Fairbanks, Berkeley, CA (US); Nathan Harding, Oakland, CA (US)

(73) Assignees: Ekso Bionics, Inc., Richmond, CA (US); The Regents of the University of California, Oakland, CA (US)

( * ) Notice: Subject to any disclaimer, the term of this patent is extended or adjusted under 35 U.S.C. 154(b) by 560 days.

(21) Appl. No.: 13/824,161

(22) PCT Filed: Sep. 19, 2011 (Under 37 CFR 1.47)

(86) PCT No.: PCT/US2011/052151

§ 371 (c)(1), (2), (4) Date: Mar. 15, 2013

(87) PCT Pub. No.: WO2012/037555

PCT Pub. Date: Mar. 22, 2012

(65) Prior Publication Data

US 2013/0231595 A1 Sep. 5, 2013

Related U.S. Application Data

(60) Provisional application No. 61/403,554, filed on Sep. 17, 2010, provisional application No. 61/390,337, filed on Oct. 6, 2010.

(51) Int. Cl.

| | |
|---|---|
| ***A61H 1/00*** | (2006.01) |
| ***A61H 1/02*** | (2006.01) |

(Continued)

(52) U.S. Cl.

CPC ..... *A61H 1/00* (2013.01); *A61H 1/0255* (2013.01); *A61H 3/00* (2013.01); *A61H 3/02* (2013.01);

(Continued)

(58) Field of Classification Search

CPC ..... A61H 1/00; A61H 1/0255; A61H 3/00

See application file for complete search history.

(56) References Cited

U.S. PATENT DOCUMENTS

| | | | |
|---|---|---|---|
| 4,697,808 | A | 10/1987 | Larson et al. |
| 7,153,242 | B2 | 12/2006 | Goffer |

(Continued)

OTHER PUBLICATIONS

Clarke, "Cutting-Edge Robotic Exoskeleton Allows Wheelchair-Bound to Stand and Walk", [online] Feb. 4, 2010 <URL:http://abcnews.go.com/GMA/OnCall/bionic-breakthrough-robotic-suit-helps-paraplegics-walk/story?id=9741496> p. 1.

(Continued)

*Primary Examiner* — Nicholas Kiswanto

(74) *Attorney, Agent, or Firm* — Diederiks & Whitelaw, PLC

(57) ABSTRACT

A powered exoskeleton configured to be coupled to lower limbs of a person is controlled to impart a movement desired by the person. The intent of the person is determined by a controller based on monitoring at least one of: positional changes in an arm portion of the person, positional changes in a head of the person, an orientation of a walking aid employed by the person, a contact force between a walking aid employed by the person and a support surface, a force imparted by the person on the walking aid, a force imparted by the person on the walking aid, a relative orientation of the exoskeleton, moveable components of the exoskeleton and the person, and relative velocities between the exoskeleton, moveable components of the exoskeleton and the person.

59 Claims, 5 Drawing Sheets

(51) Int. Cl.
*A61H 3/00* (2006.01)
*A61H 3/02* (2006.01)
*A61H 3/04* (2006.01)

(52) U.S. Cl.
CPC ..... *A61H 3/04* (2013.01); *A61H 2201/163* (2013.01); *A61H 2201/1616* (2013.01); *A61H 2201/1642* (2013.01); *A61H 2201/5007* (2013.01); *A61H 2201/5061* (2013.01); *A61H 2201/5064* (2013.01); *A61H 2201/5069* (2013.01); *A61H 2201/5079* (2013.01); *A61H 2201/5092* (2013.01)

(56) References Cited

U.S. PATENT DOCUMENTS 7,346,396 B2 3/2008 Barriskill et al.
7,396,337 B2 7/2008 McBean et al.
7,437,202 B2 10/2008 Morrell
7,883,546 B2 2/2011 Kazerooni et al.
7,901,368 B2 3/2011 Flaherty et al.
7,918,808 B2 4/2011 Simmons
7,947,004 B2 5/2011 Kazerooni et al.
8,057,410 B2 * 11/2011 Angold ..... A61H 3/00 601/35
8,096,965 B2 1/2012 Goffer et al.
2008/0009771 A1 1/2008 Perry et al.
2009/0036804 A1 2/2009 Horst
2009/0062698 A1 3/2009 Einav et al.
2011/0066088 A1 * 3/2011 Little ..... B25J 9/0006 601/35
2013/0226048 A1 * 8/2013 Unluhisarcikli ..... A61H 3/00 601/34
2013/0237884 A1 * 9/2013 Kazerooni ..... A61H 1/0244 601/34
2014/0100492 A1 * 4/2014 Nagasaka ..... A61H 3/061 601/34
2014/0196757 A1 * 7/2014 Goffer ..... A61H 3/02 135/66
2014/0276261 A1 * 9/2014 Caires ..... A61H 1/024 601/33

OTHER PUBLICATIONS

Dollar et al. "Lower Extremity Exoskeletons and Active Orthoses: Challenges and State-of-the-Art", IEEE Transactions on Robotics, vol. 24, No. 1, Feb. 2008. <URL:http://www.eng.yale.edu/grablab/pubs/dollar_TRO_Exos.pdf>.

Veneman et al., "Design and Evaluation of the LOPES Exoskeleton Robot for Interactive Gait Rehabilitation", IEEE Transactions on Neutral Systems and Rehabilitation Engineering, vol. 15, No. 3, Sep. 2007.

* cited by examiner

HUMAN MACHINE INTERFACE FOR HUMAN EXOSKELETON

CROSS-REFERENCE TO RELATED APPLICATIONS

This application represents a National Stage application of PCT/US2011/052151 entitled "Human Machine Interface for Human Exoskeleton" filed Sep. 19, 2011, which claims the benefit of U.S. Provisional Application Ser. No. 61/403,554 entitled "Human Machine Interfaces for Human Exoskeletons", filed Sep. 17, 2010 and U.S. Provisional Application Ser. No. 61/390,337 entitled "Upper Body Human Machine Interfaces for Human Exoskeletons", filed Oct. 6, 2010, all of which are incorporated herein by reference.

STATEMENT REGARDING FEDERALLY SPONSORED RESEARCH OR DEVELOPMENT

This invention was made with U.S. government support under the National Science Foundation Award #IIP-0712462 and the National Institute of Standards and Technology Award #70NANB7H7046. The U.S. government has certain rights in the invention.

BACKGROUND OF THE INVENTION

Human exoskeletons are being developed in the medical field to allow people with mobility disorders to walk. The devices represent systems of motorized leg braces which can move the user's legs for them. Some of the users are completely paralyzed in one or both legs. In this case, the exoskeleton control system must be signaled as to which leg the user would like to move and how they would like to move it before the exoskeleton can make the proper motion. Such signals can be received directly from a manual controller, such as a joystick or other manual input unit. However, in connection with developing the present invention, it is considered that operating an exoskeleton based on input from sensed positional changes of body parts or walk assist devices under the control of an exoskeleton user provides for a much more natural walking experience.

SUMMARY OF THE INVENTION

The present invention is directed to a system and method by which a user can use gestures of their upper body or other signals to convey or express their intent to an exoskeleton control system which, in turn, determines the desired movement and automatically regulates the sequential operation of powered lower extremity orthotic components of the exoskeleton to enable people with mobility disorders to walk, as well as perform other common mobility tasks which involve leg movements. The invention has particular applicability for use in enabling a paraplegic to walk through the controlled operation of the exoskeleton.

In accordance with the invention, there are various ways in which a user can convey or input desired motions for their legs. A control system is provided to watch for these inputs, determine the desired motion and then control the movement of the user's legs through actuation of an exoskeleton coupled to the user's lower limbs. Some embodiments of the invention involve monitoring the arms of the user in order to determine the movements desired by the user. For instance, changes in arm movement are measured, such as changes in arm angles, angular velocity, absolute positions, positions relative to the exoskeleton, positions relative to the body of the user, absolute velocities or velocities relative the exoskeleton or the body of the user. In other embodiments, a walking assist or aid device, such as a walker, a forearm crutch, a cane or the like, is used in combination with the exoskeleton to provide balance and assist the user desired movements. The same walking aid is linked to the control system to regulate the operation of the exoskeleton. For instance, in certain preferred embodiments, the position of the walking aid is measured and relayed to the control system in order to operate the exoskeleton according to the desires of the user. For instance, changes in walking aid movement are measured, such as changes in walking aid angles, angular velocity, absolute positions, positions relative to the exoskeleton, positions relative to the body of the user, absolute velocities or velocities relative the exoskeleton or the body of the user. In other embodiments loads applied by the hands or arms of the user on select portions of the walking aid, such as hand grips of crutches, are measured by sensors and relayed to the control system in order to operate the exoskeleton according to the desires of the user. In general, in accordance with many of the embodiments of the invention, the desire of the user is determined either based on the direct measurement of movements by select body parts of the user or through the interaction of the user with a walking aid. However, in other embodiments, relative orientation and/or velocity changes of the overall system are used to determine the intent of the user.

Additional objects features and advantages of the invention will become more readily apparent from the following detailed description of various preferred embodiments when taken in conjunction with the drawings wherein like reference numerals refer to corresponding parts in the several views.

DETAILED DESCRIPTION OF THE INVENTION

In general, the invention is concerned with instrumenting or monitoring either the user's upper body, such as the user's arms, or a user's interactions with a walking aid (e.g., crutches, walker, cane or the like) in order to determine the movement desired by the user, with this movement being utilized by a controller for a powered exoskeleton, such as a powered lower extremity orthotic, worn by the user to establish the desired movement by regulating the exoskeleton. As will become more fully evident below, various motion-related parameters of the upper body can be monitored, including changes in arm angles, angular velocity, absolute positions, positions relative to the exoskeleton, positions relative to the body of the user, absolute velocities or velocities relative the exoskeleton or the body of the user, various motion-related parameters of the walking aid can be monitored, including changes in walking aid angles, angular velocity, absolute positions, positions relative to the exoskeleton, positions relative to the body of the user absolute velocities or velocities relative the exoskeleton or the body of the user, or loads on the walking aid can be measured and used to determine what the user wants to do and control the exoskeleton.

Figure 1:
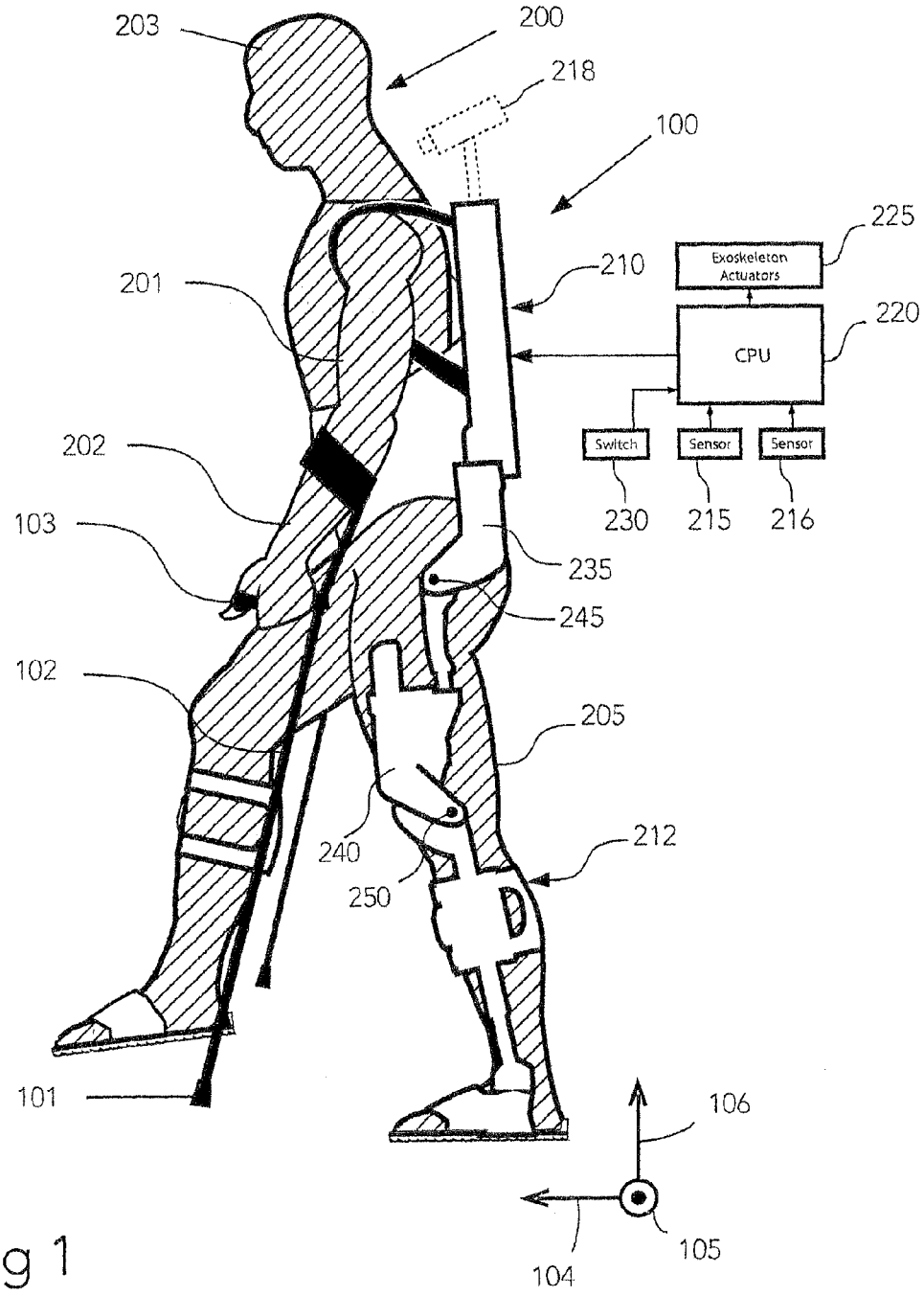
FIG. 1 is a schematic side view of a handicapped individual coupled to an exoskeleton and utilizing a walking aid in accordance with the invention.

With initial reference to FIG. 1, an exoskeleton 100 having a trunk portion 210 and lower leg supports 212 is used in combination with a crutch 102, including a lower, ground engaging tip 101 and a handle 103, by a person or user 200 to walk. The user 200 is shown to have an upper arm 201, a lower arm (forearm) 202, a head 203 and lower limbs 205. In a manner known in the art, trunk portion 210 is configurable to be coupled to an upper body (not separately labeled) of the person 200, the leg supports 212 are configurable to be coupled to the lower limbs 205 of the person 200 and actuators, generically indicated at 225 but actually interposed between portions of the leg supports 212 as well as between the leg supports 212 and trunk portion 210 in a manner widely known in the art, for shifting of the leg supports 212 relative to the trunk portion 210 to enable movement of the lower limbs 205 of the person 200. In the example shown in FIG. 1, the exoskeleton actuators 225 are specifically shown as a hip actuator 235 which is used to move hip joint 245 in flexion and extension, and as knee actuator 240 which is used to move knee joint 250 in flexion and extension. As the particular structure of the exoskeleton can take various forms, is known in the art and is not part of the present invention, it will not be detailed further herein. However, by way of example, a known exoskeleton is set forth in U.S. Pat. No. 7,883,546, which is incorporated herein by reference. For reference purposes, in the figure, axis 104 is the "forward" axis, axis 105 is the "lateral" axis (coming out of the page), and axis 106 is the "vertical" axis. In any case, in accordance with certain embodiments of the invention, it is movements of upper arm 201, lower arm 202 and/or head 203 which is sensed and used to determine the desired movement by user 200, with the determined movement being converted to signals sent to exoskeleton 100 in order to enact the movements. More specifically, by way of example, the arms of user 200 are monitored in order to determine what the user 200 wants to do. In accordance with the invention, an arm or arm portion of the user is defined as one or more body portions between the palm to the shoulder of the user, thereby particularly including certain parts such as forearm and upper arm portions but specifically excluding other parts such as the user's fingers. In one preferred embodiment, monitoring the user's arms constitutes determining changes in orientation such as through measuring absolute and/or relative angles of the user's upper arm 201 or lower arm 202 segment. Absolute angles represent the angular orientation of the specific arm segment to an external reference, such as axes 104-106, gravity, the earth's magnetic field or the like. Relative angles represent the angular orientation of the specific arm segment to an internal reference such as the orientation of the powered exoskeleton or the user themselves. Measuring the orientation of the specific arm segment or portion can be done in a number of different ways in accordance with the invention including, but not limited to, the following: angular velocity, absolute position, position relative to the powered exoskeleton, position relative to the person, absolute velocity, velocity relative to the powered exoskeleton, and velocity relative to the person. For example, to determine the orientation of the upper arm 201, the relative position of the user's elbow to the powered exoskeleton 100 is measured using ultrasonic sensors. This position can then be used with a model of the shoulder position to estimate the arm segment orientation. Similarly, the orientation could be directly measured using an accelerometer and/or a gyroscope fixed to upper arm 201. Generically, FIG. 1 illustrates sensors employed in accordance with the invention at 215 and 216, with signals from sensors 215 and 216 being sent to a controller or signal processor 220 which determines the movement intent or desire of the user 200 and regulates exoskeleton 100 accordingly as further detailed below.

As another example, if user 200 wants to take a step and is currently standing still, user 200 can navigate to a 'walking' mode by flapping one or more upper arms 201 in a predefined pattern. The powered exoskeleton 100 can then initiate a step action, perhaps only when crutch 102 is sufficiently loaded, while the orientation of the upper arm(s) 201 is above a threshold. At the same time, controller 220 for powered exoskeleton 100 evaluates the amplitude of the upper arm orientation and the modification of a trajectory of a respective leg will follow to make a proportional move with the foot through actuators of the exoskeleton as indicated at 225.

In another embodiment, the head 203 of user 200 is monitored to indicate intent. In particular, the angular orientation of the user's head 203 is monitored by measuring the absolute and/or relative angles of the head. The methods for measuring the orientation of the head are very similar to that of the arm as discussed above. For example, once measured, the user 200 can signify intent by moving their head 203 in the direction they would like to move. Such as leaning their head 203 forward to indicate intent to walk forward or leaning their head 203 to the right to indicate intent to turn right. In either of these embodiments, various sensors can be employed to obtain the desired orientation data, including accelerometer, gyroscope, inclinometer, encoder, LVDT, potentiometer, string potentiometer, Hall Effect sensor, camera and ultrasonic distance sensors. As indicated above, these sensors are generically indicated at 215 and 216, with the camera being shown at 218.

As indicated above, instead of sensing a desired movement by monitoring the movement of body portions of user 200, the positioning, movement or forces applied to a walking aid employed by user 200 can be monitored. At this point, various control embodiments according to the invention will now be described in detail with reference to the use of crutch 102 by user 200. However, it is to be understood that these principles equally apply to a wide range of walking aids, including walkers, canes and the like.

The user intent can be used to directly control the operation of the exoskeleton 100 in three primary ways: (1) navigating between operation modes, (2) initiating actions or (3) modifying actions. That is, the intent can be used to control operation of the powered exoskeleton by allowing for navigating through various modes of operation of the device such as, but not limited to, the following: walking, standing up, sitting down, stair ascent, stair decent, ramps, turning and standing still. These operational modes allow the powered exoskeleton to handle a specific action by isolating complex actions into specific clusters of actions. For example, the walking mode can encompass both the right and left step actions to complete the intended task. In addition, the intent can be used to initiate actions of powered exoskeleton 100 such as, but not limited to, the following: starting a step, starting to stand, starting to sit, start walking and end walking. Furthermore, the intent can also be used to modify actions including, but not limited to, the following: length of steps, ground clearance height of steps and speed of steps.

Another set of embodiments involve monitoring the user's walking aid in order to get a rough idea of the movement of the walking aid and/or the loads on the walking aid determine what the user wants to do. These techniques are applicable to any walking aid, but again will be discussed in connection with an exemplary walking aid in the form of forearm crutches 102. In most cases, the purpose of the instrumentation is to estimate the crutch position in space by measuring the relative or absolute linear position of the crutch 102 or by measuring the angular orientation of each crutch 102 and then estimating the respective positions of the crutches 102. The crutch's position could be roughly determined by a variety of ways, including using accelerometer/gyro packages or using a position measuring system to measure variations in distance between exoskeleton 100 and crutch 102. Such a position measuring system could be one of the following: ultrasonic range finders, optical range finders, computer vision and the like. Angular orientation can be determined by measuring the absolute and/or relative angles of the user's crutch 102. Absolute angles represent the angular orientation of crutch 102 relative to an external reference, such as axes 104-106, gravity or the earth's magnetic field. Relative angles represent the angular orientation of crutch 102 to an internal reference such as the orientation of the powered exoskeleton 100 or even user 200. This angular orientation can be measured in a similar fashion as the arm orientation as discussed above.

The linear orientation, also called the linear position or just the position, of the crutch 102 can be used to indicate the intent of the user 200. The positioning system can measure the position of the crutch 102 in all three Cartesian axes 104-106, referenced from here on as forward, lateral and vertical. This is shown in FIG. 1 as distances from an arbitrary point, but can easily be adapted to other relative or absolute reference frames, such as relative positions from the center of pressure of the powered exoskeleton 100. It is possible for the system to measure only a subset of the three Cartesian axes 104-106 as needed by the system. The smallest subset only needs a one dimensional estimate of the distance between the crutches 102 and the exoskeleton 100 to determine intent. For example, the primary direction for a one dimensional estimate would measure the approximate distance the crutch 102 is in front or behind exoskeleton 100 along forward axis 104. Such an exoskeleton could operate as follows: CPU 220 monitors the position of the right crutch via sensor 216. The system waits for the right crutch to move and determines how far it has moved in the direction of axis 104. When the crutch has moved past a threshold distance, CPU 220 would direct the left leg to take a step forward. Then the system would wait for the left crutch to move.

Figure 2:
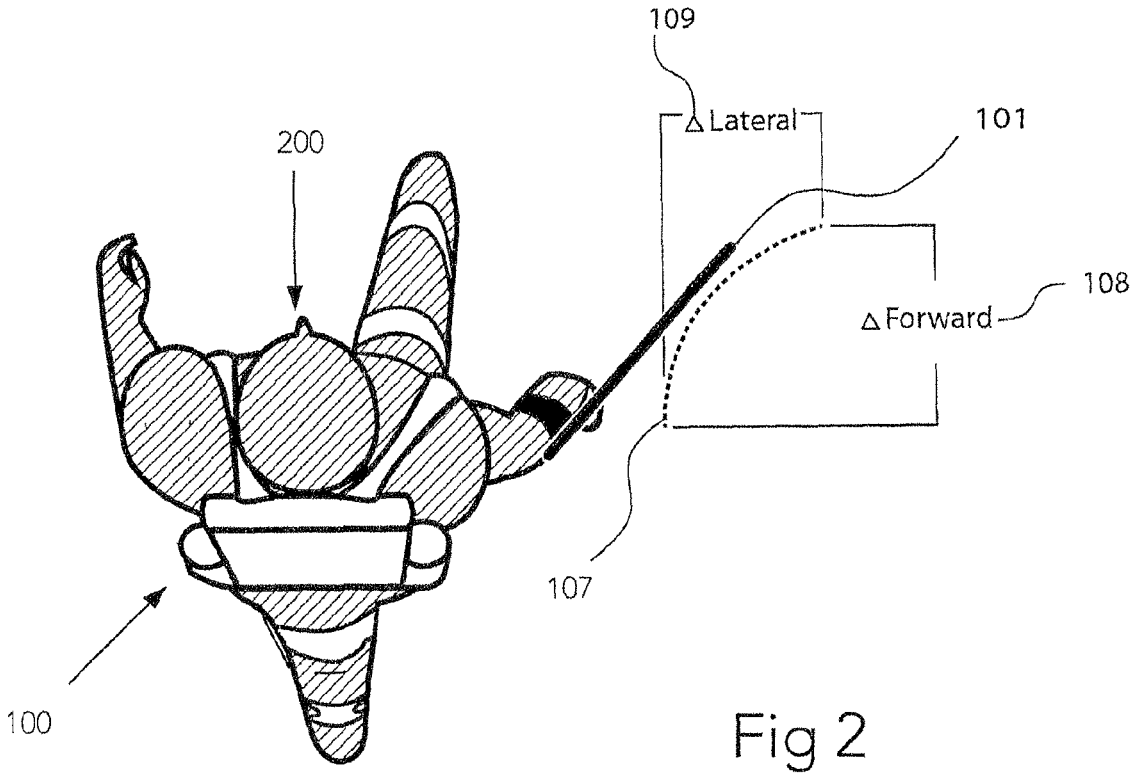
FIG. 2 is a top view of the individual, exoskeleton and walking aid of FIG. 1.

In other embodiments, a more complex subset of measurements are used which is the position of the crutch 102 in two Cartesian axes. These embodiments require a two dimensional position measurement system. Such a position measuring system could be one of the following: a combination of two ultrasonic range finders which allow a triangulation of position, a similar combination of optical range finders, a combination of arm/crutch angle sensors, and many others. One who is skilled in the art will recognize that there are many other ways to determine the position of the crutch with respect to the exoskeleton in two dimensions. The axes measured can be in any two of the three Cartesian axes 14-106, but the most typical include the forward direction 104, along with either the lateral 105 or vertical 106 direction. For example, in cases where the forward and lateral axes 104 and 105 are measured, the direction of crutch motion is used to determine whether the user 200 wanted to turn or not. For instance, when user 200 moves one crutch 102 forward and to the right, this provides an indication that user 200 wants to take a slight turn to the right as represented in FIG. 2. More specifically, FIG. 2 shows a possible trajectory 107 which could be followed by crutch tip 101. Trajectory 107 moves through a forward displacement 108 and a lateral displacement 109.

Figure 3:
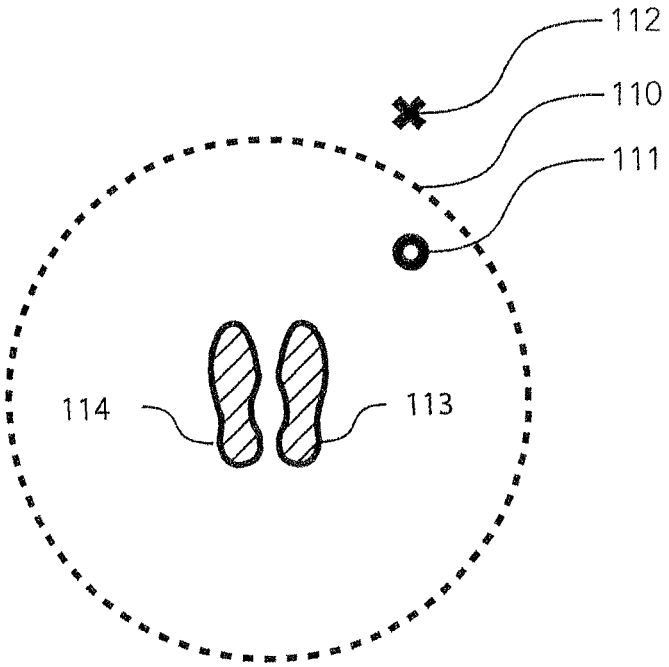
FIG. 3 illustrates a virtual boundary region associated with a control system for the exoskeleton.

In one such embodiment, the system determines if a crutch 102 has been put outside of a "virtual boundary" to determine whether the user 200 wants to take a step or not. This "virtual boundary" can be imagined as a circle or other shape drawn on the floor or ground around the feet of user 200 as shown by item 110 in FIG. 3. As soon as the crutch is placed on the ground, controller 220 determines if it was placed outside of boundary 110. If it is, then a step is commanded; if it is not outside boundary 110, the system takes no action. In the figure, item 111 represents a position inside the boundary 110 resulting in no action and item 112 represents a position outside the boundary 110 resulting in action. The foot positions 113 and 114 are also shown for the exoskeleton/user and, in this case, the boundary 110 has been centered on the geometrical center of the user/exoskeleton footprints. This "virtual boundary" technique allows the user 200 to be able to mill around comfortably or reposition their crutches 102 for more stability without initiating a step. At this point, it should be noted that provisions may be made for user 200 to be able to change the size, position, or shape of boundary 110, such as through a suitable, manual control input to controller 220, depending on what activity they are engaged in.

In still other embodiments, the system measures the position of the crutch 102 in all three spatial axes, namely the forward, lateral and vertical axes 104-106 respectively. These embodiments require a three dimensional position measurement system. Such a position measuring system could be one of the following: a combination of multiple ultrasonic range finders which allow a triangulation of position, a similar combination of optical range finders, a combination of arm/crutch angle sensors, a computer vision system, and many others. In FIG. 1, camera 218 may be positioned such that crutch 102 is within its field of view and could be used by a computer vision system to determine crutch location. Such a camera could be a stereoscopic camera or augmented by the projection of structured light to assist in determining position of crutch 102 in three dimensions. One who is skilled in the art will recognize that there are many other ways to determine the position of the crutch with respect to the exoskeleton in three dimensions.

In another embodiment, the swing leg can move in sync with the crutch. For example the user could pick up their left crutch and the exoskeleton would lift their right leg, then, as the user moved their left crutch forward, the associated leg would follow. If the user sped up, slowed down, changed directions, or stopped moving the crutch, the associated leg would do the same thing simultaneously and continue to mirror the crutch motion until the user placed the crutch on the ground. Then the exoskeleton would similarly put the foot on the ground. When both the crutch and exoskeleton leg are in the air, the leg essentially mimics what the crutch is doing. However, the leg may be tracking a more complicated motion which includes knee motion and hip motion to follow a trajectory like a natural step while the crutch of course is just moving back and forth. One can see that this behavior would allow someone to do more complex maneuvers like walking backwards.

An extension to these embodiments includes adding instrumentation to measure crutch-ground contact forces. This method can involve sensors in the crutches to determine whether a crutch is on the ground or is bearing weight. The measurement of the load applied through crutch 102 can be done in many ways including, but not limited to, the following: commercial load cell, strain gauges, pressure sensors, force sensing resistors, capacitive load sensors and a potentiometer/spring combination. Depending on the embodiment, the sensor to measure the crutch load can be located in many places, such as the tip 101, a main shaft of crutch 102, handle 103, or even attached to the hand of user 200, such as with a glove. With any of these sensors, a wireless communication link would be preferred, to communicate their measurement back to the controller 220. In each case, the sensed signals are used to refine the interpretation of the user's intent. These embodiments can be further aided by adding sensors in the feet of the exoskeleton to determine whether a foot is on the ground. There are many ways to construct sensors for the feet, with one potential method being described in U.S. Pat. No. 7,947,004 which is incorporated herein by reference. In that patent, the sensor is shown between the user's foot and the exoskeleton. However, for a paralyzed leg, the sensor may be placed between the user's foot and the ground or between the exoskeleton foot and the ground. Some embodiments of the crutch and/or foot load sensor could be enhanced by using an analog force sensor on the crutches/feet to determine the amount of weight the user is putting on each crutch and foot. An additional method of detecting load through the user's crutch is measuring the load between the user's hand and the crutch handle, such as handle 103 of FIG. 1. Again, there are many known sensors, including those listed above, that one skilled in the art could readily employ, including on the crutch handle or mounted to the user's hand such as on a glove.

Figure 4:
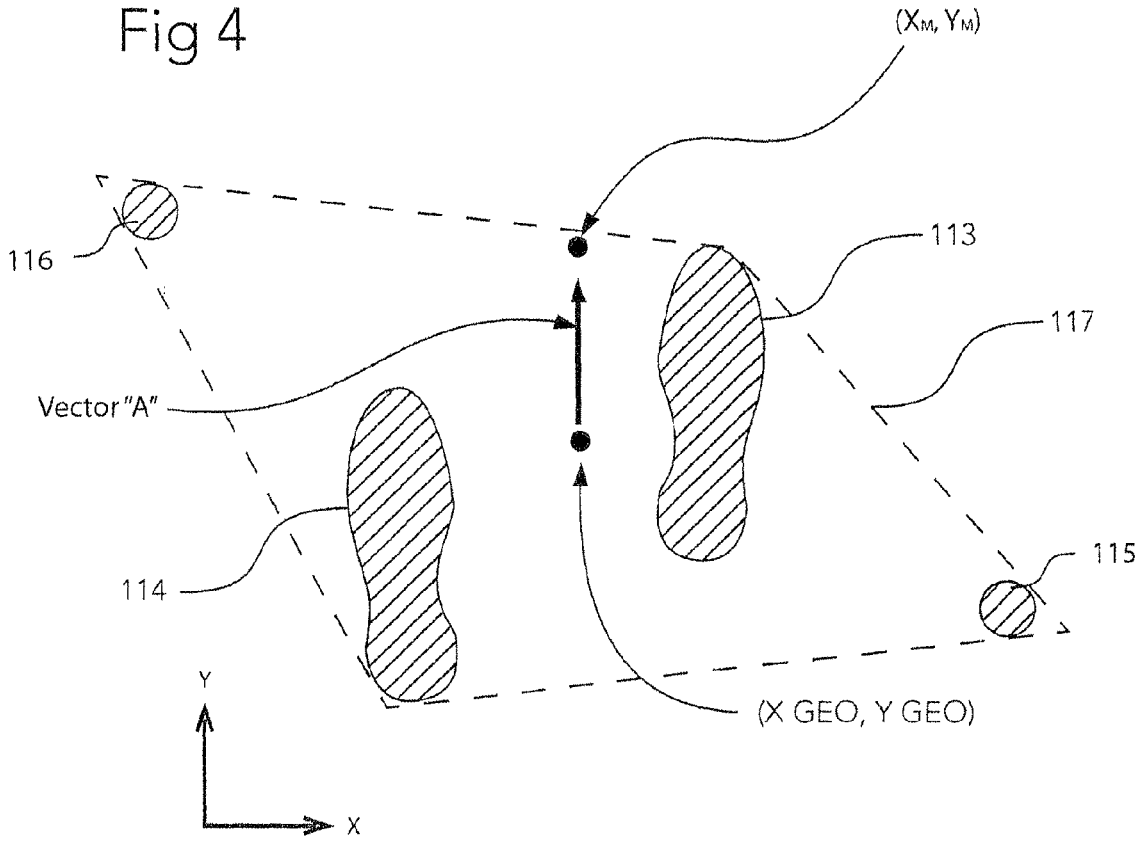
FIG. 4 illustrates another virtual boundary region associated with a walking sequence for the user of the exoskeleton utilizing the walking aid.

In another embodiment, by combining the position information for the feet and crutches with the load information for each, the center of mass of the complete system can be estimated as well. This point is referred to as the "center of mass", designated with the position (Xm, Ym). It is determined by treating the system as a collection of masses with known locations and known masses and calculating the center of mass for the entire collection with a standard technique. However, in accordance with this embodiment, the system also determines the base of support made by whichever of the user's feet and crutches are on the ground. By comparing the user's center of mass and the base of support, the controller can determine when the user/exo system is stable, i.e., when the center of mass is within the base of support and also when the system is unstable and falling, i.e., the center of mass is outside the base of support. This information is then used to help the user maintain balance or the desired motion while standing, walking, or any other maneuvers. This aspect of the invention is generally illustrated in FIG. 4 depicting the right foot of the user/exoskeleton at 113 and the left foot of the user/exoskeleton at 114. Also shown are the right crutch position at 115, the left crutch tip position at 116, and the point (Xm, Ym). The boundary of the user/exoskeleton base of support is designated as 117. Additionally, this information can be used to determined the system's zero moment point (ZMP) which is widely used by autonomous walking robots and is well known by those skilled in the art.

Another embodiment (also shown in FIG. 4) relies on all the same information as used in the embodiment of the previous paragraph, but wherein the system additionally determines the geometric center of the base of support made by the user's feet and the crutch or crutches who are currently on the floor. This gives the position (Xgeo, Ygeo) which is compared to the system's center of mass as discussed above (Xm, Ym) to determine the user's intent. The geometric center of a shape can be calculated in various known ways. For example, after calculating an estimate of both the geometric center and the center of mass, a vector can be drawn between the two. This vector is shown as "Vector A" in FIG. 4. The system uses this vector as the indicator of the direction and magnitude of the move that the user wants to make. In this way, the user could simply shift their weight in the direction that they wanted to move, and the system then moves the user appropriately. In accordance with another method of calculation: if the left crutch is measuring 15 kgf, the right crutch is measuring 0 kgf, the left foot is measuring 25 kgf and the right foot is measuring 20 kgf, then the system's center of mass would be calculated by treating the system as a collection of 3 masses with a total mass of 60 kg with the three masses located at the known positions. By drawing a vector A from the point (Xgeo, Ygeo) to the point (Xm, Ym), the system uses this as the indicator of the direction and magnitude of the move that the user desires.

This system could also be augmented by including one or more input switches 230 which are actually directly on the walking aid (here again exemplified by the crutch) to determine intent from the user. For example, the switch 230 could be used to take the exoskeleton out of the walk mode and prevent it from moving. This would allow the user to stop walking and "mill around" without fear of the system interpreting a crutch motion as a command to take a step. There are many possible implementations of the input switch, such as a button, trigger, lever, toggle, slide, knob, and many others that would be readily evident to one skilled in the art upon reading the foregoing disclosure. At this point, it should be realized that intent for these embodiments preferably controls the powered exoskeleton just as presented previously in this description in that it operates under three primary methods, i.e., navigating modes of operation, initiating actions or modifying actions. For example, the powered exoskeleton can identify the cadence, or rate of motion, that the crutches are being used and match the step timing to match them.

Figure 5A:
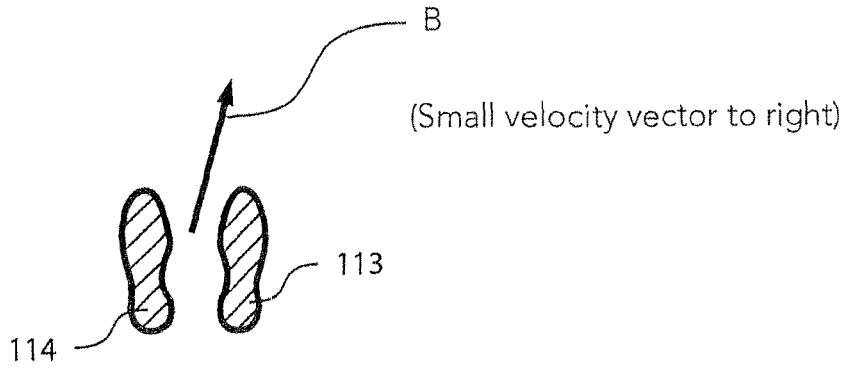
FIG. 5*a* illustrates a velocity vector measured in accordance with an embodiment of the invention to convey a user's desire to turn to the right.
Figure 5B:
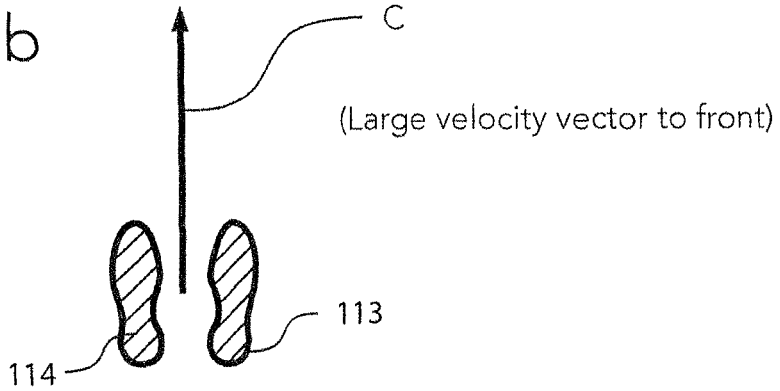
FIG. 5*b* illustrates a velocity vector measured in accordance with an embodiment of the invention to convey a user's desire to walk forward at an enhanced pace.

In a still further embodiment, the system would actually determine the velocity vector of the complete system's center of mass and use that vector in order to determine the user's intent. The velocity vector magnitude and direction could be determined by calculating the center of mass of the system as described above at frequent time intervals and taking a difference to determine the current velocity vector. For example, the magnitude of the velocity vector could be used to control the current step length and step speed. As the user therefore let's their center of mass move forward faster, the system would respond by making longer more rapid steps. As represented in FIG. 5*a*, the velocity vector B is of small magnitude and headed to the right, indicating that the user wants to turn to the right. The velocity vector C in FIG. 5*b* is of large magnitude and directed straight ahead, indicating that the user wants to continue steady rapid forward walking. This type of strategy might be very useful when a smooth continuous walking motion is desired rather than the step by step motions that would result if the system waited for each crutch move before making the intent determination and controlling the exoskeleton.

In a rather simple embodiment employing a walking aid, the system can measure the distance that the crutch is moved each time, and then makes a proportional move with the exoskeleton foot. The system would measure the approximate distance the crutch is in front or behind the exoskeleton. To clarify, the system only needs a one dimensional estimate of the distance between the crutches and the exoskeleton in the fore and aft direction. The controller would receive signals on how far the user moved the crutch in this direction while determining the user's intent. The user could move the crutch a long distance if they desired to get a large step motion or they could move it a short distance to get a shorter step. One can imagine that some capability of making turns could be created by the user choosing to move the right foot farther on each step than the left foot, for example. In this embodiment, it is assumed that the user moves the crutch, the system observes the movement of the crutch, and then it makes a leg movement accordingly.

Again, extra sensors at the feet and crutches can be used to determine when to move a foot. Many ways to do this are possible. For instance, when all four points (right foot, left foot, right crutch, left crutch) are on the ground, the control system waits to see a crutch move, when a crutch is picked up, the control system starts measuring the distance the crutch is moved until it is replaced on the floor. Then the system may make a move of the opposite foot of a proportional distance to that which the crutch was moved. The system picks up the foot, until the load on the foot goes to zero, then swings the leg forward. The system waits to see that the foot has again contacted the floor to confirm that the move is complete and will then wait for another crutch to move. To give a slightly different gait, the left crutch movement could be used to start the left foot movement (instead of the foot opposite the crutch moved).

In any of the previous embodiments, the system could wait until the user unloads a foot before moving it. For example, if a person made a crutch motion that indicated the person desires a motion of the right foot, the system could wait until they remove their weight from the right foot (by leaning their body to the left) before starting the stepping motion.

Based on the above, it should be readily apparent that there are many methods which could be used in accordance with the present invention to identify intent from the measured user information, whether it is orientation, force or other parameters. Certainly, one simple example is to identify intent as when a measured or calculated value raises above a predefined threshold. For example, if the crutch force threshold is set at 10 pounds, the signal would trigger the intent of user 200 to act when the measured signal rose above the 10 pound threshold. Another example for identifying intent is when a measured signal resembles a predefined pattern or trajectory. For example, if the predefined pattern was flapping upper arms up and down three (3) times, the measured signal would need to see the up and down motion three times to signify the intent of user.

Each of the previous embodiments have been described as a simple process which makes decisions one step at a time by observing the motions of a crutch/arm before a given step. However, natural walking is a very fluid process which must make decisions for the next step before the current step is over. To get a truly fluid walk, therefore, these strategies would require the exoskeleton to initiate the next step before the crutch motion of the previous step was complete. This can be accomplished by not waiting for the crutch to encounter the ground before initiating the next step.

Although described with reference to preferred embodiments of the invention, it should be recognized that various changes and/or modifications of the invention can be made without departing from the spirit of the invention. In particular, it should be noted that the various arrangements and methods disclosed for use in determining the desired movement or intent of the person wearing the exoskeleton could also be used in combination with each other such that two or more of the arrangements and methods could be employed simultaneously, with the results being compared to confirm the desired movements to be imparted. In any case, the invention is only intended to be limited by the scope of the following claims.

We claim:

1. A method of controlling a powered exoskeleton configured to be coupled to lower limbs of a person comprising:

establishing a control parameter based on monitoring at least one of: positional changes in an arm portion of the person, positional changes in a head of the person, an orientation of a walking aid employed by the person, a contact force between a walking aid employed by the person and a support surface, a force imparted by the person on a walking aid used by the person, a force imparted by the person on a walking aid used by the person, a relative orientation of the exoskeleton, moveable components of the exoskeleton and the person, and relative velocities between the exoskeleton, moveable components of the exoskeleton and the person;

determining a desired movement for the lower limbs of the person based on the control parameter; and controlling the exoskeleton to impart the desired movement.

2. The method of claim 1 wherein said exoskeleton further includes a plurality of modes of operation and wherein the method uses the intent to establish an operational mode from said plurality of modes of operation.

3. The method of claim 1 wherein said exoskeleton further includes a plurality of modes of operation and wherein the method uses the intent to modify at least one characteristic of an operational mode of the plurality of modes of operation.

4. The method of claim 3 wherein the operational mode constitutes stepping.

5. The method of claim 4 wherein said characteristic is a length of a step.

6. A method of controlling a powered exoskeleton configured to be coupled to lower limbs of a person comprising:

establishing a control parameter based on monitoring positional changes in an arm portion of the person;

determining a desired movement for the lower limbs of the person based on the control parameter; and controlling the exoskeleton to impart the desired movement.

7. The method of claim 6 wherein the control parameter is established based on monitoring an orientation of the arm portion of the person.

8. The method of claim 7 where the orientation of the arm portion is monitored through the use of at least one sensor measuring at least one of acceleration, angular velocity, absolute position, position of the arm portion relative to a portion of the exoskeleton, position of the arm portion relative to another body portion of the person, absolute velocity, velocity relative to the exoskeleton, and velocity relative to the person.

9. A method of controlling a powered exoskeleton configured to be coupled to lower limbs of a person comprising:

establishing a control parameter based on an orientation of a head of the person;

determining a desired movement for the lower limbs of the person based on the control parameter; and controlling the exoskeleton to impart the desired movement.

10. The method of claim 9, further comprising: determining when the exoskeleton should turn based on the orientation of the head of the person.

11. A method of controlling a powered exoskeleton configured to be coupled to lower limbs of a person comprising:

establishing a control parameter based on an orientation of a walking aid employed by the person;

determining a desired movement for the lower limbs of the person based on the control parameter; and controlling the exoskeleton to impart the desired movement.

12. The method of claim 11 further comprising: manually initiating or changing a mode of operation of the exoskeleton through operation of at least one switch provided on the walking aid.

13. The method of claim 11 wherein the walking aid constitutes at least one crutch.

14. The method of claim 13 wherein at least one sensor is employed to measure an angular orientation of said at least one crutch.

15. The method of claim 14 further comprising: measuring the angular orientation with respect to gravity.

16. The method of claim 14 further comprising: measuring the angular orientation with respect to a magnetic field of the earth.

17. The method of claim 14 further comprising: measuring the angular orientation with respect to the exoskeleton.

18. The method of claim 11 wherein a linear position of said walking aid is measured.

19. The method of claim 18 further comprising:

defining a space around the exoskeleton utilizing three mutually orthogonal axes, with a first of said orthogonal axes lying in a plane parallel with the supporting surface and extending parallel to a direction in which the person is facing, a second of said orthogonal axes lying in a plane parallel with the supporting surface and extending perpendicular to the direction in which the person is facing, and a third of said orthogonal axes being mutually orthogonal to both the first and second axes, and measuring the linear position along at least one of said first, second and third axes.

20. The method of claim 19 wherein the linear position is measured from the exoskeleton to the walking aid along the first axis.

21. The method of claim 19 wherein the linear position is constituted by a position of a ground contact point of the walking aid in all three mutually orthogonal axes.

22. The method of claim 11 further comprising: controlling trajectories of motion of said exoskeleton as a function of the orientation of the walking aid.

23. The method of claim 11 further comprising:

recording the orientation over a period of time to produce an orientation trajectory;

comparing said orientation trajectory to a plurality of trajectories, each of which corresponds to a possible user intention, and determining the intent of the person to be the possible user intention if the orientation trajectory is sufficiently close to the possible user intention.

24. The method of claim 11 further comprising:

determining the orientation from at least two sensor signals;

recording the at least two sensor signals over a period of time; and paramaterizing at least a first one of the at least two sensor signals as a function of a second one of at least two signals to produce an orientation trajectory that is not a function of time;

comparing the orientation trajectory to a plurality of trajectories, each of which corresponds to a possible user intention, and determining the intent of the person to be said possible user intention if said orientation trajectory is sufficiently close to said possible user intention.

25. The method of claim 11 further comprising:

establishing a virtual boundary measured in a common space with said orientation;

controlling the exoskeleton to initiate a gait when the orientation is outside the virtual boundary; and controlling the exoskeleton to not initiate a gait when the orientation is within said virtual boundary.

26. The method of claim 25 wherein said virtual boundary is in a plane of a support surface for the walking aid.

27. The method of claim 26 wherein the virtual boundary is constituted by a circle on the plane of the supporting surface.

28. A method of controlling a powered exoskeleton configured to be coupled to lower limbs of a person comprising:

establishing a control parameter based on a contact force between a walking aid employed by the person and a support surface;

determining a desired movement for the lower limbs of the person based on the control parameter; and controlling the exoskeleton to impart the desired movement.

29. The method of claim 28 further comprising:

measuring a position and magnitude of a human-orthotic reaction force applied by the exoskeleton and the person to the support surface; and calculating a geometric center of vertical components of the contact force and the human-orthotic reaction force.

30. A method of controlling a powered exoskeleton configured to be coupled to lower limbs of a person comprising:

establishing a control parameter based on a force imparted by the person on a walking aid used by the person;

determining a desired movement for the lower limbs of the person based on the control parameter; and controlling the exoskeleton to impart the desired movement.

31. The method of claim 30 wherein said force is measured between the walking aid and a supporting surface.

32. The method of claim 30 wherein said force is measured between the person and the walking aid.

33. The method of claim 30 wherein said force is measured by a sensor selected from the group consisting of: strain gauges, hall effect force sensors, piezoelectric sensors, and position measurement sensors.

34. A method of controlling a powered exoskeleton configured to be coupled to lower limbs of a person comprising:

establishing a control parameter constituted by a position of a total center of mass of the person and the exoskeleton by:

measuring a relative orientation of the exoskeleton, moveable components of the exoskeleton, and the person, and calculating the position of the total center of mass of the person and the exoskeleton from the relative orientation;

determining a desired movement for the lower limbs of the person based on the control parameter; and controlling the exoskeleton to impart the desired movement.

35. The method of claim 34 further comprising:

calculating a boundary of a support base of the exoskeleton and the person;

comparing the position of the total center of mass to said boundary; and determining the intent of the person based on a direction from a center of the support base to the position of the total center of mass.

36. The method of claim 34 further comprising: controlling the exoskeleton to maintain the position of the total center of mass over a support base, whereby both the person and the exoskeleton are maintain in upright positions.

37. A method of controlling a powered exoskeleton configured to be coupled to lower limbs of a person comprising:

establishing a control parameter constituted by a velocity of a total center of mass of the person and the exoskeleton by:

measuring relative velocities between the exoskeleton, moveable components of the exoskeleton and the person, and calculating the velocity of the total center of mass of the person and the exoskeleton from the relative velocities;

determining a desired movement for the lower limbs of the person based on the control parameter; and controlling the exoskeleton to impart the desired movement.

38. The method of claim 37 further comprising: using a direction of a component in the plane of the ground of said velocity of the total center of mass to determine an intended direction of motion of the person.

39. The method of claim 38 further comprising: using a magnitude of the component in the plane of the ground of said velocity of the total center of mass to determine an intended speed of horizontal motion of the person.

40. A powered lower extremity orthotic, configurable to be coupled to a person, said powered lower extremity orthotic comprising:

an exoskeleton including a trunk portion configurable to be coupled to an upper body of the person, at least one leg support configurable to be coupled to at least one lower limb of the person and at least one actuator for shifting of the at least one leg support relative to the trunk portion to enable movement of the lower limb of the person;

at least one sensor positioned to measure positional changes of an arm or head portion of said person; and a controller for determining a desired movement for the lower limb of the person and operating the at least one actuator to impart the desired movement based on signals received from the at least one sensor.

41. The powered lower extremity orthotic of claim 40 wherein said at least one sensor measures an orientation of a forearm of the person.

42. The powered lower extremity orthotic of claim 40 wherein said at least one sensor measures an orientation of an upper arm portion of the person.

43. The powered lower extremity orthotic of claim 40 wherein said at least one sensor measures an orientation of a head of the person.

44. The powered lower extremity orthotic of claim 40 wherein the at least one sensor is selected from the group consisting of: accelerometer, gyroscope, inclinometer, encoder, LVDT, potentiometer, string potentiometer, Hall Effect sensor, camera and ultrasonic distance sensor.

45. The powered lower extremity orthotic of claim 40 wherein the at least one sensor constitutes a camera and the controller includes a video signal processor for recording video data from the camera, and controller calculating a distance to a plurality of points within a field of view of the camera in measuring the positional changes.

46. The powered lower extremity orthotic of claim 40 wherein the at least one sensor is selected from the group consisting of: acceleration sensor, angular velocity sensor, position sensor and velocity sensor.

47. An orthotic system comprising:

a powered lower extremity orthotic, configurable to be coupled to a person, said powered lower extremity orthotic including an exoskeleton including a trunk portion configurable to be coupled to an upper body of the person, at least one leg support configurable to be coupled to at least one lower limb of the person and at least one actuator for shifting of the at least one leg support relative to the trunk portion to enable movement of the lower limb of the person;

a walking aid for use by the person;

at least one sensor positioned to measure an orientation of the walking aid; and a controller for determining a desired movement for the lower limb of the person and operating the at least one actuator to impart the desired movement based on signals received from the at least one sensor.

48. The orthotic system of claim 47, further comprising: at least one switch provided on the walking aid and linked to the controller to manually changing a mode of operation of the exoskeleton.

49. The orthotic system of claim 47 wherein the walking aid constitutes at least one crutch.

50. The orthotic system of claim 49 wherein the at least one sensor is employed to measure an angular orientation of said at least one crutch.

51. The orthotic system of claim 47 wherein the at least one sensor is employed to measure a linear position of said walking aid.

52. An orthotic system comprising:

a powered lower extremity orthotic, configurable to be coupled to a person, said powered lower extremity orthotic including an exoskeleton including a trunk portion configurable to be coupled to an upper body of the person, at least one leg support configurable to be coupled to at least one lower limb of the person and at least one actuator for shifting of the at least one leg support relative to the trunk portion to enable movement of the lower limb of the person;

a walking aid for use by the person;

at least one sensor positioned to measure a contact force between the walking aid and a support surface; and a controller for determining a desired movement for the lower limb of the person and operating the at least one actuator to impart the desired movement based on signals received from the at least one sensor.

53. The orthotic system of claim 52 wherein the at least one sensor measures a position and magnitude of a human-orthotic reaction force applied to the exoskeleton and the person to the support surface.

54. An orthotic system comprising:

a powered lower extremity orthotic, configurable to be coupled to a person, said powered lower extremity orthotic including an exoskeleton including a trunk portion configurable to be coupled to an upper body of the person, at least one leg support configurable to be coupled to at least one lower limb of the person and at least one actuator for shifting of the at least one leg support relative to the trunk portion to enable movement of the lower limb of the person;

a walking aid for use by the person;

at least one sensor positioned to measure a force imparted by the person on the walking aid; and a controller for determining a desired movement for the lower limb of the person and operating the at least one actuator to impart the desired movement based on signals received from the at least one sensor.

55. The orthotic system of claim 54 wherein the contact force is measured between the walking aid and the support surface.

56. The orthotic system of claim 54 wherein the contact force is measured between the person and the walking aid.

57. The orthotic system of claim 54 wherein the at least one sensor is selected from the group consisting of: strain gauges, hall effect force sensors, piezoelectric sensors, and position measurement sensors.

58. An orthotic system comprising:

a powered lower extremity orthotic, configurable to be coupled to a person, said powered lower extremity orthotic including an exoskeleton including a trunk portion configurable to be coupled to an upper body of the person, at least one leg support configurable to be coupled to at least one lower limb of the person and at least one actuator for shifting of the at least one leg support relative to the trunk portion to enable movement of the lower limb of the person;

a walking aid for use by the person;

at least one sensor positioned to measure a relative orientation of the exoskeleton, moveable components of the exoskeleton, and the person; and a controller for calculating a position of a total center of mass of the person and the exoskeleton from the relative orientation, determining a desired movement for the lower limb of the person based on the position of the total center of mass and operating the at least one actuator to impart the desired movement.

59. An orthotic system comprising:

a powered lower extremity orthotic, configurable to be coupled to a person, said powered lower extremity orthotic including an exoskeleton including a trunk portion configurable to be coupled to an upper body of the person, at least one leg support configurable to be coupled to at least one lower limb of the person and at least one actuator for shifting of the at least one leg support relative to the trunk portion to enable movement of the lower limb of the person;

a walking aid for use by the person;

at least one sensor positioned to measure relative velocities between the exoskeleton, moveable components of the exoskeleton and the person; and a controller for calculating a velocity of a total center of mass of the person and the exoskeleton from the relative velocities, determining a desired movement for the lower limb of the person based on the velocity of the total center of mass and operating the at least one actuator to impart the desired movement.

* * * * *